US007381879B2

(12) United States Patent
Tamura

(10) Patent No.: US 7,381,879 B2
(45) Date of Patent: Jun. 3, 2008

(54) SOUND WAVEFORM SYNTHESIZER

(75) Inventor: Motoichi Tamura, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 486 days.

(21) Appl. No.: 11/090,663

(22) Filed: Mar. 25, 2005

(65) Prior Publication Data

US 2005/0211070 A1 Sep. 29, 2005

(30) Foreign Application Priority Data

Mar. 26, 2004 (JP) ..... 2004-091517
Mar. 26, 2004 (JP) ..... 2004-091518

(51) Int. Cl.
*G10H 7/00* (2006.01)

(52) U.S. Cl. ..... 84/604

(58) Field of Classification Search ..... 84/602–604
See application file for complete search history.

(56) References Cited

U.S. PATENT DOCUMENTS 5,446,237 A 8/1995 Abe et al.
5,525,748 A 6/1996 Kuribayashi et al.
5,668,336 A 9/1997 Miyano
5,811,706 A 9/1998 Van Buskirk et al.
2001/0017076 A1* 8/2001 Fujita et al. ..... 84/603

FOREIGN PATENT DOCUMENTS

EP 0 747 878 12/1996

* cited by examiner

*Primary Examiner*—Jeffrey Donels
(74) *Attorney, Agent, or Firm*—Morrison & Foerster LLP

(57) ABSTRACT

In a sound waveform synthesizer, a waveform data supplying section reads the waveform data from a storage medium for supplying the waveform data to a waveform buffer in response to a first transfer request. A waveform data processing section retrieves the waveform data from the waveform buffer in response to a second transfer request. The waveform data processing section performs sound waveform synthesis based on the retrieved waveform data and given control parameters, while notifying a state and progress of the sound waveform synthesis to a control data processing section. The control data processing section issues the first transfer request based on the notified progress of the sound waveform synthesis. The control data processing section receives waveform control information from an outside and creates the control parameters based on the waveform control information and the notified state of the sound waveform synthesis. The control data processing section issues the second transfer request corresponding to the first transfer request together with the created control parameters to the waveform data processing section.

7 Claims, 6 Drawing Sheets

SOUND WAVEFORM SYNTHESIZER

BACKGROUND OF THE INVENTION

1. Technical Field

The present invention relates to a sound waveform synthesizer for synthesizing waveform data to produce a sound waveform, such as a musical sound or voice.

2. Background Art

Electronic music apparatuses having a sound generation system of waveform memory type (waveform table type) are known, which process waveform data as materials according to performance data to synthesize a musical sound waveform.

FIGS. 4(*a*), 4(*b*) and 4(*c*) are block diagrams showing some electronic music apparatuses having a waveform memory type sound generation system.

In FIG. 4(*a*), a CPU (Central Processing Unit) 102 for control of the sound generation, a work RAM (Random Access Memory) 103, and a sound generation LSI (Large Scale Integrated Circuit) 104 are connected to a CPU bus 101. The sound generation LSI 104 is connected to a waveform ROM (Read Only Memory) 106 via a waveform memory bus 105.

A processing program for operating the CPU 102 is loaded in the work RAM 103. On the other hand, the performance data (musical waveform control information) is inputted to the work RAM 103 through the CPU bus 101 from a keyboard or the like, not shown. The CPU 102 creates sound generation parameters (control parameters) based on the performance data, and outputs them to the sound generation LSI 104. The sound generation LSI 104 reads out waveform data as materials from the waveform ROM (Read Only Memory) 106 according to the sound generation parameters. Then the LSI processes the waveform data to synthesize a musical sound waveform. The synthesized musical sound waveform is converted to an analog signal by a CODEC (coder/decoder), not shown, to generate a musical sound signal.

As shown in FIG. 4(*b*), a DSP (Digital Signal Processor) 107 for sound generation may be used instead of the sound generation LSI.

The DSP is a microprocessor dedicated to digital signal processing. It features high-speed summation and multiplication operations. It can also replace the sound generation system with another system or upgrade it by changing the microprogram codes. The musical sound waveform synthesized by the DSP 107 is converted by the CODEC, not shown, to the analog signal so that the analog signal will be outputted.

The DSP 107 may be of the type that shares a bus (DSP bus 108) and a work RAM 110 between processed waveform data used in the signal processing and the signal processing program instructions.

However, since the CPU 102 and the DSP 107 both have a function for assigning bus access right, so-called arbitration function, they cannot share the bus.

It is generally known that a shared memory connects two buses as disclosed in Japanese patent laid-open application No. 6-59678. Therefore, a shared memory 109 is provided in FIG. 4(*b*), with the work RAM 110 connected to the DSP bus 108.

On the other hand, the waveform ROM 106 is scaled up to increase a capacity to store the waveform data enough to reproduce high-quality musical sound waveforms.

However, there is a cost limit for such a large-capacity waveform ROM to store waveform data for diverse tone colors of various musical instruments.

To solve this, there is yet another configuration as shown in FIG. 4(*c*), in which an HDD (Hard Disk Drive) 113 is connected to the CPU bus 101 through a HDC (Hard Disk Controller) 112, while using a waveform RAM 111.

In this case, the CPU 102 transfers waveform data from the HDD (Hard Disk Drive) 113 to the work RAM 103 prior to starting the music performance. Then the CPU 102 transfers and stores the waveform data into the waveform RAM 111. Practically, the CPU 102 accesses the HDD 113 to transfer the waveform data of the tone color of a required musical instrument from the HDD 113 to the waveform RAM 111 through the work RAM 103. However, when changing the tone color to another, waveform data of the tone color of another musical instrument needs to be transferred to the waveform RAM 111. This causes another problem that it takes time to change the waveform data. There is also a limit to the data size storable in the waveform RAM 111 at a reasonable cost.

Therefore, there is another method called sampler method. In the musical sound synthesis processing after starting the performance, waveform data necessary for musical sound synthesis is supplied one by one from the HDD 113 to the waveform RAM 111 through the work RAM 103. According to this system, users can access virtually unlimited amounts of waveform data. This system is implemented as a "sampler" program running on a personal computer.

However, since the latency from receiving a request to read waveform data to actual reading from the HDD 113 is too important to neglect, large amounts of waveform data necessary for musical sound synthesis need to be read out and prestored in the work RAM 103.

The CPU bus 101 is mainly used for sound generation parameter synthesis. This processing requires a relatively large-scale program with a complicated algorithm, the processing load of which is very high.

However, the CPU bus incorporated in the system is slower than CPU bus for a personal computer. Further, the speed of the CPU bus is just a fraction of the speed of the internal operation of the CPU. The CPU 102 is designed to use 70 to 80 percent of the data transfer capacity at worst to execute the command "fetch" at its busiest time.

Therefore, if too much of the data transfer capacity of the CPU bus 101 is taken up by the transfer of waveform data between the HDC 112 and the work RAM 103, the CPU 102 cannot provide enough computing power.

A musical sound data recording/reproducing apparatus is known as disclosed in Japanese patent laid-open application No. 6-51776, in which an HDD is connected to a bus other than a bus on the reproduction side and the CPU bus so that waveform data read out from the HDD will be transferred to the bus on the reproduction side through a shared buffer.

FIG. 5 is a block diagram showing such a conventional musical sound data recording/reproducing apparatus. In this configuration, other block for recording waveform data on the HDD is not shown.

A personal computer 121 and a reproduction control device 122 are connected via a serial cable. Further, the personal computer 121, the reproduction control device 122, and an HDD 123 are connected via SCSI (Small Computer System Interface) buses, respectively.

The personal computer 121 allows users to perform selection and setting operations on file names, and sends out information for specifying the location of the data file to the reproduction control device 122 via the serial cable.

The reproduction control device 122 reads out musical sound waveform data stored in the HDD 123 via the SCSI bus to reproduce the musical sound waveform data.

In the reproduction control device 122, a microcomputer consisting predominantly of a CPU 126, a RAM 127, and a ROM 128 are connected to a CPU bus 125. A serial input/output interface 124, a SCSI interface 129, a reproduction/transfer controller 130, and a sound generator 131 are also connected to the CPU bus 125. The operation of these components is controlled by the CPU 126.

The reproduction/transfer controller 130 is provided with a capture buffer 134. The capture buffer 134 is connected to the SCSI interface 129 through a waveform data bus 132, and to a reproduction buffer 135 through a bus 133.

The musical sound waveform data read out from the HDD 123 are stored in the capture buffer 134. After removing unnecessary header parts and rearranging the data, the capture buffer 134 transfers one block (16K words) of musical sound waveform data, a suitable unit for reproduction and reading, to the reproduction buffer 135 (two 4K words). The writing/reading operations of the capture buffer 134 are switched by a system clock pulse 1 or 0, respectively.

The reproduction sound generator 131 reads out and outputs one block of musical sound waveform data from the reproduction buffer 135 in response to a sampling clock. During this processing, the pitch of the read waveform can be controlled.

As disclosed in Japanese patent laid-open application No. 6-51776, such a configuration that the capture buffer 134 is provided between the waveform data bus 132 and the waveform reproduction bus 133 allows both of the buses to transfer musical sound waveforms independently of each other.

The transfer function disclosed in Japanese patent laid-open application No. 6-51776 is to read out and reproduce a predetermined block size of waveform data from the HDD 123.

In other words, Japanese patent laid-open application No. 6-51776 does not teach how each bus transfers waveform data read out from a storage with large latency such as the HDD 123 when the amount of waveform data necessary for musical sound waveform synthesis varies according to time-varying factors such as performance data (musical waveform control information).

SUMMARY OF THE INVENTION

The present invention has been made to solve the above-mentioned problems, and it is an object of the present invention to provide a sound waveform synthesizer capable of reading waveform data from a storage medium and transferring it to a signal processing section efficiently.

In one aspect of the invention, there is provided a sound waveform synthesizer apparatus for performing a sound waveform synthesis based on waveform control information provided from an outside and waveform data stored in a storage medium. The sound waveform synthesizer apparatus comprises waveform data supplying section, a waveform buffer, a waveform data processing section and a control data processing section. The waveform data supplying section receives a notification of a first transfer request and that reads the waveform data from the storage medium for supplying the waveform data in response to the first transfer request. The waveform buffer is connected to the waveform data supplying section for storing the waveform data supplied from the waveform data supplying section. The waveform data processing section receives a notification of a second transfer request and that is connected to the waveform buffer for transferring the waveform data from the waveform buffer to the waveform data processing section in response to the second transfer request. The waveform data processing section performs the sound waveform synthesis based on the transferred waveform data and given control parameters, while notifying a state of the sound waveform synthesis and a progress of the sound waveform synthesis. The control data processing section creates the first transfer request based on the progress of the sound waveform synthesis notified from the waveform data processing section, and sends the waveform data supplying section the notification of the first transfer request. The control data processing section receives the waveform control information from the outside and creating the control parameters based on the waveform control information and the state of the sound waveform synthesis notified from the waveform data processing section. The control data processing section sends the waveform data processing section the notification of the second transfer request corresponding to the first transfer request together with the created control parameters.

Preferably, the waveform data processing section comprises a first bus, a first storage connected to the first bus for storing the waveform data, and a digital signal processor connected to the first bus for processing the waveform data during the sound waveform synthesis, while the waveform data supplying section comprises a second bus, a reading device for reading the waveform data from the storage medium and feeding the read waveform data to the second bus, and a second storage connected to the second bus for storing the waveform data, such that the waveform buffer is connected between the first bus and the second bus to transfer the waveform data from the second storage of the waveform data supplying section to the first storage of the waveform data processing section through the waveform buffer.

In such a case, the control data processing section further creates a reading request according to the waveform control information, and sends a notification of the reading request to the reading device of the waveform data supplying section. The reading device operates when receiving the notification of the reading request for reading out the waveform data from the storage medium and transferring the read waveform data to the second storage.

Further, the waveform data supplying section includes a controller for controlling the second bus such that the transfer of the waveform data from the second storage to the waveform buffer is given higher priority than the transfer of the waveform data from the storage medium to the second storage.

Further, the control data processing section sends the notification of the reading request to the reading device of the waveform data supplying section prior to start of the input of the waveform control information into the control data processing section so that the waveform data will be transferred in advance of the sound waveform synthesis to the second storage from the storage medium.

Preferably, the waveform data processing section performs the sound waveform synthesis to synthesize a sound waveform a frame by frame basis based on the waveform data in synchronization with a given frame period such that each frame contains a give number of samples of the sound waveform, and wherein the waveform data supplying section operates when receiving the notification of the first transfer request for transferring the waveform data from the storage medium to the waveform buffer in correspondence to the frame period.

In another aspect of the invention, there is provided a method of operating a sound waveform synthesizer apparatus comprised of a waveform data supplying section, a waveform buffer, a waveform data processing section and a control data processing section for performing a sound waveform synthesis based on waveform control information and waveform data. The inventive method is carried out by the steps of: operating the waveform data supplying section when receiving a notification of a first transfer request from the control data processing section for reading the waveform data from a storage medium and supplying the read waveform data to the waveform buffer in response to the first transfer request; operating the waveform buffer for storing the waveform data supplied from the waveform data supplying section; operating a waveform data processing section when receiving a notification of a second transfer request from the control data processing section for transferring the waveform data from the waveform buffer to the waveform data processing section in response to the second transfer request; operating the waveform data processing section to perform the sound waveform synthesis based on the transferred waveform data and control parameters fed from the control data processing section, while notifying a state of the sound waveform synthesis and a progress of the sound waveform synthesis to the control data processing section; operating the control data processing section to create the first transfer request based on the progress of the sound waveform synthesis notified from the waveform data processing section and to send the waveform data supplying section the notification of the first transfer request; operating the control data processing section when receiving the waveform control information for creating the control parameters based on the waveform control information and the state of the sound waveform synthesis notified from the waveform data processing section; and operating the control data processing section to send the waveform data processing section the notification of the second transfer request corresponding to the first transfer request together with the created control parameters.

In this structure, the use of the waveform buffer makes it possible to control the synthesis of a sound waveform performed by the waveform data processing section and the reading of the waveform data from the storage medium performed by the waveform data supplying section independently of each other during the sound waveform synthesis processing. Since the waveform data processing section can transfer waveform data from the waveform buffer at convenient timings, the influence of the reading of waveform data from the storage medium on the sound waveform synthesis processing can be reduced.

In this structure, the transfer on the first bus among the digital signal processor, the first storage, and the waveform buffer, and the transfer of waveform data or the like on the second bus among the storage medium reading device, the transfer controller, the second storage, and the waveform buffer are controlled independently of each other during the sound waveform synthesis processing. It allows the signal processor to transfer the waveform data between the first storage and the waveform buffer efficiently at convenient timings.

Further, since the second bus is controlled so that the transfer of waveform data from the second storage to the waveform buffer is given higher priority than the transfer of waveform data from the storage medium to the second storage, the influence of transfer from the storage medium on the sound waveform synthesis processing can be reduced.

In addition, the storage medium reading device performs the transfer of waveform data from the storage medium to the second storage and the transfer of waveform data from the second storage to the waveform buffer, respectively. This makes it possible to transfer efficiently waveform data stored in the storage medium with longer delay than the second storage.

Further, since one frame of waveform data is synthesized as a unit, the amount of waveform data to be processed by the waveform data processing section is made uniform in time. In other words, since the amount of processed waveform data does not vary so much frame to frame, the waveform data processing section can operate steady.

In addition, the transfer of waveform data performed by the waveform data processing section and the transfer of waveform data performed by the waveform data supplying section are performed in synchronization with a given frame period, so that the amount of waveform data transferred at a time becomes reasonably large in size, thereby enabling efficient transfer with less overhead.

According to the present invention, the use of the waveform buffer makes possible the reading and transfer of waveform data from a large-capacity storage medium such as a hard disk with large latency to the waveform data processing section during the operation of generating a music sound. Therefore, a high-quality music sound can be synthesized even in real time.

During the data reading and transfer operations, the data transfer capacity of the bus to which the signal processor is connected can be used efficiently.

During the data reading and transfer operations, the waveform data are transferred in units of frames, so that the data transfer capacity can be used efficiently.

As a result, a reduction in the processing power of the waveform data processing section can be prevented, and hence there are obtained a number of simultaneously generated sounds enough for practical use.

BRIEF DESCRIPTION OF THE DRAWINGS

FIGS. 3-1 and 3-2 are a sequence diagram for explaining an example of processing timing of each component in the specific example of FIG. 2.

DETAILED DESCRIPTION OF THE INVENTION

Figure 1:
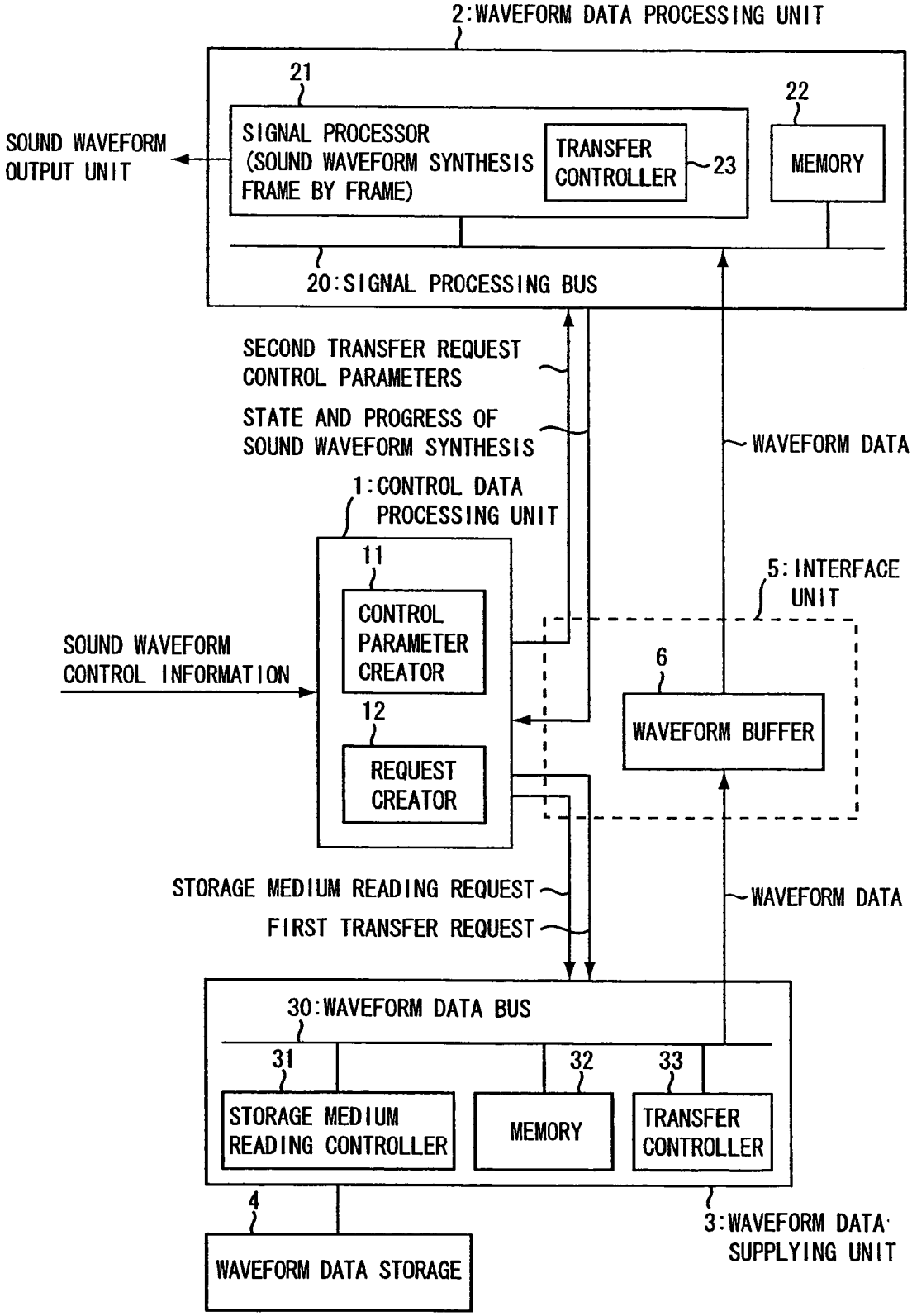
FIG. 1 is a block diagram for explaining the functional structure of one preferred embodiment of the present invention.

FIG. 1 is a block diagram for explaining the functional structure of one preferred embodiment of the present invention.

The embodiment provides a sound waveform synthesizer as an electronic music apparatus or the like for performing sound waveform synthesis based on waveform control information and waveform data stored in a storage. In the sound waveform synthesizer, a section denoted by reference number 1 is a control data processing unit, a section denoted by 2 is a waveform data processing unit, a section denoted by 3 is a waveform data supplying unit, and section denoted by 5 is an interface unit.

The waveform data supplying unit 3 is connected to a waveform data storage 4 such as an HDD.

The interface unit 5 connects the control data processing unit 1, the waveform data processing unit 2, and the waveform data supplying unit 3 to one another. A waveform buffer 6 connects the waveform data processing unit 2 and the waveform data supplying unit 3, providing a buffer relay for, the transfer of waveform data. This allows the waveform data processing unit 2 to synthesize a sound waveform and the waveform data supplying unit 3 to read out waveform data individually without causing interference with each other.

Various methods can be adopted for the interfaces between the control data processing unit 1 and the waveform data processing unit 2, and between the control data processing unit 1 and the waveform data supplying unit 3. In the illustrated example, these interfaces are direct connections.

The control data processing unit 1, the waveform data processing unit 2, and the waveform data supplying unit 3 perform internal processing independently of one another on a stand-alone basis. In the illustrated example, however, these operations are consolidated in units of frame periods corresponding to predetermined multiple sampling periods.

The waveform data processing unit 2 has a signal processing bus (first bus) 20 to which a digital signal processor 21 and a memory (first storage) 22 are connected. The signal processing unit 21 has also a built-in transfer controller (first transfer controller) 23. The output of the signal processing unit 21 is connected to a sound waveform output unit, not shown.

The waveform data processing unit 2 synthesizes one frame of sound waveform frame by frame based on acquired control parameters and transferred waveform data. The synthesized multiple samples of sound waveform are supplied to the sound waveform output unit from which one sample of sound waveform is outputted every sampling period.

The sound waveform synthesis on a frame basis can be performed in response to the supply of a frame sync signal from the sound waveform output unit. In this case, the frame sync signal corresponds to predetermined multiple sampling clock pulses.

The waveform data processing unit 2 acquires, from the control data processing unit 1, control parameters necessary for sound waveform synthesis at least for the current frame period. Meanwhile, the transfer controller 23 transfers waveform data, necessary for sound waveform synthesis at least for the current frame period, from the waveform buffer 6 to the memory 22.

The acquisition of the control parameters and the transfer of the waveform data can be performed in units of frame periods according to the progress of sound waveform synthesis.

The units of frame periods means a time interval that is an integer multiple of one frame period. The value of the integer multiple may vary at different times.

The waveform data processing unit 2 may also perform sound waveform synthesis on each sample of sound waveform. However, the number of samples of waveform data used for sound waveform synthesis varies depending on the conditions such as pitch. Therefore, the amount of waveform data temporarily supplied may be insufficient, and this may cause noise in the synthesized waveform. It is preferable that the signal processing unit 21 performs the processing frame by frame, each frame having a reasonable size, because it can suppress the variations of necessary waveform data.

Further, if sound waveform synthesis is done for each sample of sound waveform, the waveform data may have to be transferred sample by sample. In such a case, a certain amount of overhead is needed each time one sample of waveform data is transferred. In contrast, if sound waveform synthesis is done by the frame, the waveform data can also be transferred every frame period on the signal processing bus 20 or the waveform data bus 30, thereby achieving high-speed, efficient data transfer.

The waveform data processing unit 2 synthesizes a sound waveform frame by frame, and this introduces one frame of delay. However, such a delay will be practically insignificant unless one frame period is extremely long.

The following describes a specific structure of the waveform data processing unit 2.

The signal processor 21 synthesizes a sound waveform frame by frame based on the control parameters and the waveform data stored in the memory 22, while it notifies the control data processing unit 1 of the state and progress of sound waveform synthesis.

Upon receipt of the notification of a waveform data transfer request (second transfer request) from the control data processing unit 1, the transfer controller 23 transfers waveform data from the waveform buffer 6 to the memory 22.

The signal processor 21 can perform internal signal processing even during the transfer of waveform data on the signal processing bus 20.

The multiple samples of sound waveform synthesized by the signal processor 21 are supplied to sound waveform output unit, not shown, and outputted sample by sample for each sampling period.

The state and progress of sound waveform synthesis can be notified every frame period in conjunction with the sound waveform synthesis processing.

The control data processing unit 1 has a control parameter creator 11 and a request creator 12, to which the waveform control information is inputted. In the case of an electronic music apparatus, the waveform control information inputted is performance information, which is outputted from a keyboard or read out from a music data storage.

As mentioned above, the waveform data processing unit 2 uses waveform data transferred from the waveform buffer 6 piece by piece each time a waveform for one sound is synthesized. Therefore, it needs such a new piece of waveform data that it is located immediately behind the synthesized piece of sound waveform data in sequence. Further, when the generation of a different kind of sound is instructed, the waveform data used until that time becomes unnecessary, and the transfer of a new kind of waveform data is required.

In such a case, the request creator 12 of the control data processing unit 1 receives the notification of the progress of sound waveform synthesis from the signal processor 21, and calculates the remaining amount of waveform data necessary for further sound waveform synthesis from the waveform data acquired by the waveform data processing unit 2 and stored in the memory 22. Then, it sends the waveform data supplying unit 3 the notification of the first transfer request to request waveform data determined from the calculation results as being newly necessary for sound waveform synthesis. The first transfer request includes information for specifying certain pieces of waveform data to be supplied.

The request creator 12 then sends the waveform data processing unit 2 the notification of the second transfer request created according to the first transfer request so that requested waveform data will be transferred from the waveform buffer 6 to the signal processor 21.

The first transfer request and the second transfer request can be sent every frame period in conjunction with the sound waveform synthesis processing. In such a case, the waveform data processing unit 2 may provide a frame sync signal.

If the waveform data processing unit 2 needs no new waveform data, both the first transfer request and the second transfer request are not notified.

The first transfer request and the second transfer request may also be sent when the amount of waveform data necessary for sound waveform synthesis and remaining in the memory 22 becomes equal to or less than a predetermined amount.

In addition, instead of the remaining amount of waveform data, the first transfer request and the second transfer request may be sent according to the amount of waveform data already consumed for sound waveform synthesis.

The request creator 12 sends a storage medium reading controller (reading device) 31 a reading request to read out in advance, from the waveform data storage (storage medium) 4, waveform data expected from the inputted waveform control information to be newly necessary for further sound waveform synthesis. The amount of readable waveform data is determined not to exceed the available memory space after the waveform data have been transferred from a memory 32 to the waveform buffer 6.

On the other hand, the control parameter creator 11 creates control parameters based on the waveform control information and the state of sound waveform synthesis, and notifies the waveform data processing unit 2 of the control parameters created. The notification of the control parameters can also be sent every frame period in conjunction with the sound waveform synthesis processing.

Upon receipt of the first transfer request, the waveform data supplying unit 3 transfers waveform data newly required for sound waveform synthesis from the memory 32 to the waveform buffer 6.

Then, upon receipt of the second transfer request, the waveform data processing unit 2 transfers the waveform data from the waveform buffer 6 to the memory 22.

The following describes a specific structure of the waveform data supplying unit 3.

The waveform data supplying unit 3 has a waveform data bus (second bus) 30 to which the storage medium reading controller (reading device) 31, the memory (second storage) 32, and a transfer controller (second transfer controller) 33 are connected.

Upon receipt of the above-mentioned first transfer request, the transfer controller 33 selects at least part of the waveform data stored in the memory 32 to transfer it from the memory 32 to the waveform buffer 6.

Then, upon receipt of the above-mentioned reading request, the storage medium reading controller 31 reads out waveform data from the memory of the waveform data storage 4 to transfer it to the memory 32.

Bus arbitration is performed to arbitrate bus transfers on the waveform data bus 30 in such a manner that the transfer of waveform data from the memory 32 is given higher priority than the transfer of waveform data to the memory 32 to avoid a shortage of waveform data transferred for sound waveform synthesis to the waveform data processing unit 2 through the waveform buffer 6.

If the waveform data is transferred on the waveform data bus 30 every frame period, burst mode transfer is enabled, thereby achieving high-speed, efficient transfer. Such a transfer may be done in immediate response to each first transfer request notified every frame period. Alternatively, it may be done by the supply of a frame sync signal from the waveform data processing unit 2 or the like.

The control data processing unit 1 may send the storage medium reading controller 31 the notification of the reading request prior to starting the input of the above-mentioned waveform control information, so that waveform data expected to be necessary at the time of staring the input of the waveform control information are transferred in advance from the waveform data storage 4 to the memory 32.

In such a case, once the input of the waveform control information is started, the waveform data necessary for sound waveform synthesis after the start of the session can be transferred from the memory 32 to the waveform buffer 6 in a short time.

When the waveform data processing unit 2 synthesizes two or more sound waveforms concurrently on multiple channels, the control data processing unit 1 is notified of information on the state and progress of sound waveform synthesis on a channel basis. The control parameter creator 11 notifies the waveform data processing unit 1 of control parameters for each channel, while the request creator 12 notifies the first and second requests for each channel. The waveform data supplying unit 3 reads out waveform data for each channel and supplies the waveform data for each channel to the waveform buffer 6.

The above describes that the control parameters, the second transfer request, the state of sound waveform synthesis, the progress of sound waveform synthesis, and the first transfer request are notified in units of frame periods in conjunction with the sound waveform synthesis processing. However, they are not necessarily notified in units of frame periods.

On the other hand, it is preferable that the transfer of waveform data from the waveform data supplying unit 3 to the waveform buffer 6 and the transfer of waveform data from the waveform buffer 6 to the waveform data processing unit 2 should be done in units of frame periods. This is because, if the waveform data are transferred in units of frame periods, the amount of waveform data transferred at a time becomes reasonably large in size, and hence the amount of overhead becomes relatively small. Further, since burst mode transfer is enabled, transfer efficiency is also improved.

Figure 2:
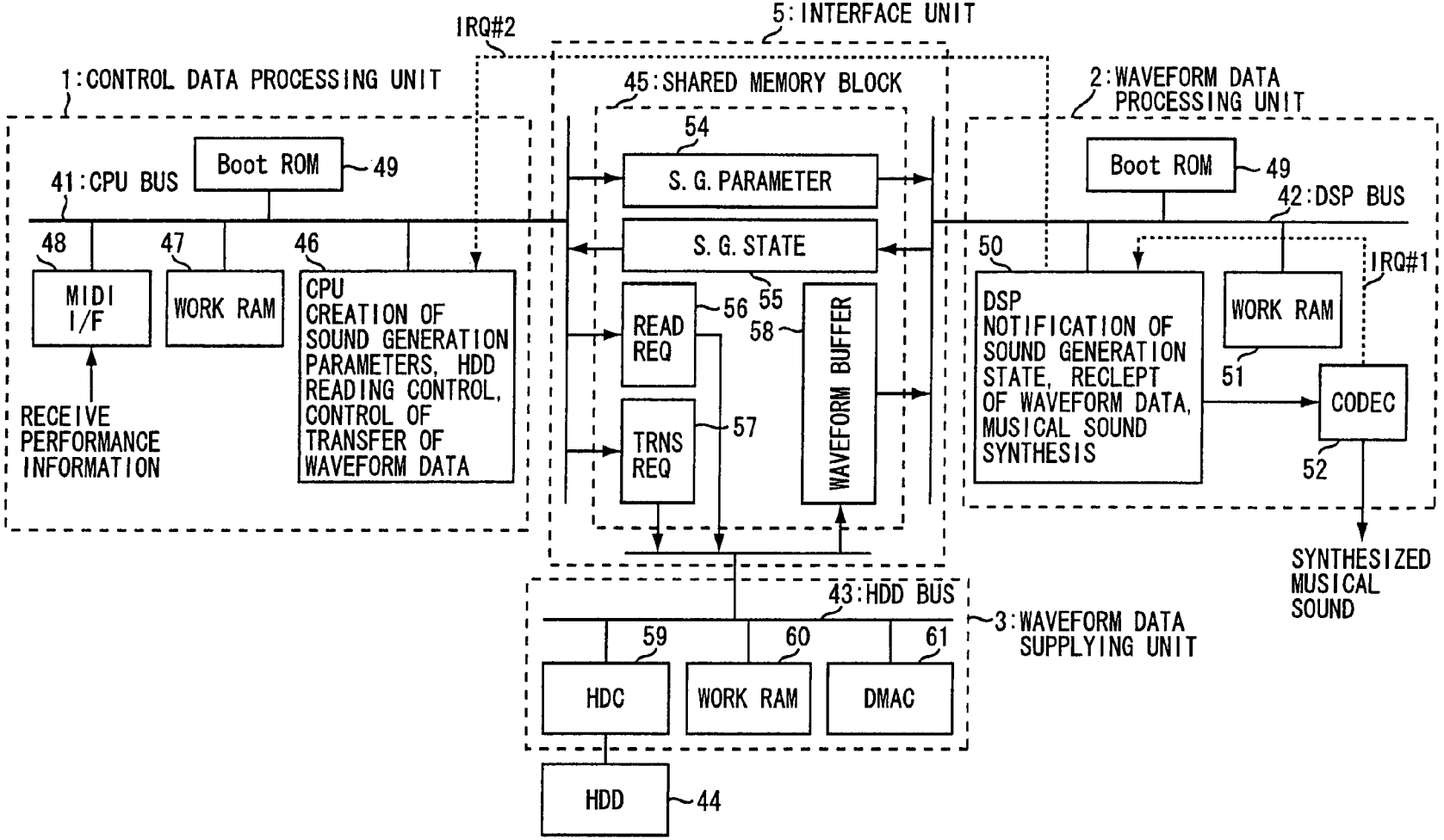
FIG. 2 is a block diagram showing a specific example in which the embodiment shown in FIG. 1 is applied to an electronic music apparatus of a waveform memory sound generation system.

FIG. 2 is a block diagram showing a specific example in which the embodiment shown in FIG. 1 is applied to an electronic music apparatus of a waveform memory sound generation system. In FIG. 2, portions similar to those in FIG. 1 are given the same numerals.

The electronic music apparatus is of three-bus structure consisting of a CPU bus 41 for control data processing, a DSP bus 42 corresponding to the signal processing bus 20 in FIG. 1, and an HDD bus 43 corresponding to the waveform data bus 30 in FIG. 1. Data transfer between these buses is performed via a shared memory block 45 in the interface unit 5. This reduces the occurrence of access contentions on one bus, and hence the traffic jam on the bus.

The control data processing unit 1, the waveform data processing unit 2, and the waveform data supplying unit 3 operate in units of frame periods through the interface unit 5.

The interface unit 5 has the shared memory block 45 and a hardware interrupt line for IRQ#2. On the other hand, IRQ#1 is a hardware interrupt from a CODEC 52 to a DSP 50, which is generated every 64 samples (one frame). The IRQ#1 is a trigger for frame processing in the DSP 50. On the other hand, the IRQ#2 is a hardware interrupt from the DSP 50 to a CPU 46, which is generated every frame period, but at different timing from the IRQ#1. In other words, the IRQ#2 is a trigger for frame processing in the CPU 46.

The control data processing unit 1 is provided with the CPU bus 41. The CPU 46 and a work RAM 47, which implement the functions of the control parameter creator 11 and the request creator 12 shown in FIG. 1, a MIDI (Musical Instrument Digital Interface) interface 48 for inputting performance information (waveform control information), a boot ROM 49 for loading a CPU control program into the work RAM 47 at power-on, and the like are connected to the CPU bus 41. If the CPU 46 includes a MIDI interface, the MIDI interface 48 may be replaced with that of the CPU 46. The other blocks, such as input operators, a display, an I/O interface, an effector LSI, and the like, which are nothing to do with the present invention, are not shown in FIG. 2.

The CPU 46 reads out the processing program from the work RAM 47, reads and writes the work RAM 47 to temporarily store data, and reads and writes the shared memory block 45 as needed. The CPU 46 occupies the CPU bus 41.

Most of the data transfer capacity of the CPU bus 41 is used for the CPU 46 to read the command "fetch" upon execution of the processing program on the work RAM 47.

The waveform data processing unit 2 is connected to the DSP bus 42, through which it is connected with the DSP 50 functioning as the signal processing unit 50 in FIG. 1, a work RAM 51 functioning as the memory 22, a boot ROM 53 for loading a control program into the work RAM 51 at power-on, and the like. The DSP 50 is connected to the CODEC 52 functioning as the sound waveform output unit.

The DSP 50 reads out the control program from the work RAM 51, reads and writes the work RAM 51 to temporarily store data, and reads and writes the shared memory block 45 as needed. The DSP 50 occupies the DSP bus 42.

Processing for sound waveform synthesis performed by the DSP 50 has a relatively simple processing algorithm based on repetition processing (loop processing). Particularly, since operations corresponding to the repetition processing in the program require such a small memory space that they can be stored in a command cache in the DSP 50, the command "fetch" hardly needs the band of the DSP bus 42. The majority of the transfer capacity is used for the transfer of waveform data from a waveform shared memory 58 to the work RAM 51 and the transfer of processed data between the DSP 50 and the work RAM 51.

The work RAM 51 temporarily stores and holds, for each channel, certain pieces of waveform data corresponding in number to the maximum number of channels capable of generating sounds at the same time. Each channel is made up of a buffer capable of storing "management information" and "4096 samples of partial waveforms."

The DSP 50 may also output digital waveform data without through the CODEC 52. If an effector LSI is connected to the CPU bus 41 and controlled by the CPU 46, the musical sound waveform data synthesized in the DSP 50 will be supplied to the input terminal of the effector LSI. In this case, the effector imparts the waveform data with an effect(s), D/A converts and outputs it.

On the other hand, the waveform data supplying unit 3 is connected to the HDD bus 43, through which it is connected with an HDC 59 functioning as the storage medium reading controller 31 in FIG. 1, a work RAM 60 functioning as the memory 32, a DMAC 61 functioning as the transfer controller 33.

In this case, instead of the waveform data storage 4 in FIG. 1, a large-capacity HDD 44 capable of storing bulk data is used though it has large latency.

The HDD 44 can not only accumulate a massive amount of waveform data, but also transfer the waveform data at high speed. When the HDD 44 is the latest type, it is a general rule that the sequential access rate is about 30 to 40 Mbps and the random access rate is about 10 to 20 Mbps.

However, delay time from receiving a reading request to starting reading is very long, about some 10 ms. Therefore, if the user wants to generate musical sounds in real time, the delay time until the start of sounding will have to be within 10 ms.

To this end, the waveform data are read out in advance from the HDD 44 and temporarily stored in the work RAM 60.

The HDD bus 43 is mainly used for the transfer of waveform data from the HDD 44 to the work RAM 60 and the transfer of the waveform data from the work RAM 60 to the waveform buffer 58.

Therefore, at least part of waveform data is transferred twice on the HDD bus 43 during different transfer periods.

Since the waveform data transferred from the HDD 44 and the work RAM 60 are waveform data expected to be newly necessary, all the pieces of waveform data do not need to be transferred from the work RAM 60 to the waveform buffer 58. It can be the that the amount of waveform data transferred per unit time (usage ratio of the bus band) from the work RAM 60 to the waveform buffer 58 is lower than that from the HDD 44 to the work RAM 60.

The number of times that waveform data is transferred per unit time from the work RAM 60 to the waveform buffer 58 (for example, once for one frame) is also larger than that from the HDD 44 to the work RAM 60, that is, the amount of transfer each time is small.

Therefore, the DSP bus 42 and the HDD bus 43 are provided to share the load of transferring waveform data, taking a load off the DSP bus 42.

The work RAM 60 is made up of a memory and ring buffers. The memory statically stores the first part of waveform data that could be sounded on system startup (for example, the first one-half second part), for each of all the keycodes for all the tone colors (each of pitches for all the keys performed on the keyboard). The ring buffers are provided as many as the maximum number of channels capable of generating sounds at the same time. The static memory may be shared among the channels.

The ring buffers have a constant storage capacity, respectively, where the read and write addresses are circulated. New waveform data are written over previous data in order. Each of the ring buffers stores, for example, waveform data for one and a half seconds.

The management information for the work RAM 60 is held by the CPU 46 on the side of the control data processing unit 1.

The shared memory block 45 is connected between the two buses to logically couple them. It can be accessed from both the buses, serving as a liaison for data passing between the buses. The shared memory block 45 can be read or written from each bus asynchronously at any timing.

The shared memory block may be implemented using a dual port RAM, a FIFO (First In First Out), or with a time sharing mechanism for switching a RAM between the two buses in response to a high-speed clock. The shared memory block 45 is made up of dedicated hardware. The functions of the shared memory block 45 may also be implemented using an FPGA (Field Programmable Gate Array). In this case, the shared memory block 45 can incorporate the functions of the DMAC 61.

In the interface unit 5, the transfer of information on the sound generation parameters and the sound generation state, and the transfer of the reading request and the transfer requests, as well as the transfer of waveform data performed by the waveform buffer 6 in FIG. 1, are done through the waveform buffer shared memory 58, a sound generation parameter shared memory 54, a sound generation state shared memory 55, a reading request shared memory 56, and a transfer request shared memory 57, respectively.

The sound generation parameter shared memory 54 and the sound generation state shared memory 55 are connected between the CPU bus 41 and the DSP bus 42. The reading request shared memory 56 and the transfer request shared memory 57 are connected between the CPU bus 41 and the HDD bus 43. The waveform buffer shared memory 58 is connected between the HDD bus 43 and the DSP bus 42.

The waveform buffer shared memory 58 is implemented using a ring buffer; it holds part of waveform data stored in the work RAM 60.

The management information for the waveform buffer shared memory 58 is held by the CPU 46. The ring buffer stores only waveform data.

The following describes sound generation parameters.

The "sound generation parameters" in FIG. 2 include parameters for instructing "transfer from the waveform buffer shared memory 58 to the work RAM 51" (the second transfer request in FIG. 1) as well as "normal sound generation parameters" (control parameters in FIG. 1).

The "normal sound generation parameters" include the key-on, note number, envelope level, etc.

The sound generation parameters are updated in units of frame periods and written in a format of "packet size+packet body (16 bit×n)" (n is a positive integer) from the first part of the sound generation parameter shared memory 54. If there is no sound parameter to be transferred in a frame period, "0" will be written for the packet size. Two or more sound generation parameters can be stored in the above-mentioned packet body.

The following describes the "transfer request."

The "transfer request" is notified when a request is made for transfer from the work RAM 60 to the waveform buffer shared memory 58.

The transfer request is composed of the "start address for transfer on the work RAM 60"+"transfer size"+"sounding channel on the destination side."

The following describes the "sound generation state."

The "sound generation state" in FIG. 2 include information indicating "the progress of musical sound waveform synthesis" (the progress of sound waveform synthesis in FIG. 1) as well as information on "the normal sound generation state" (the state of sound waveform synthesis in FIG. 1).

The information indicating "the normal sound generation state" includes the key-on state, the current state of the envelope level, etc., like those prescribed for existing tone generators.

On the other hand, the information indicating "the progress of musical sound waveform synthesis" is information on the position of waveform data currently processed for musical sound synthesis. The waveform position is a sounding position with respect to the position of the note-on set to "0" as a reference point. For example, the waveform position is represented as the cumulative number of samples.

The sound generation state shared memory 55 is such a map to indicate the state of each sound generation for each of the channels capable of generating sounds at the same time. This memory is preassigned its memory address.

Figures 1, 3:
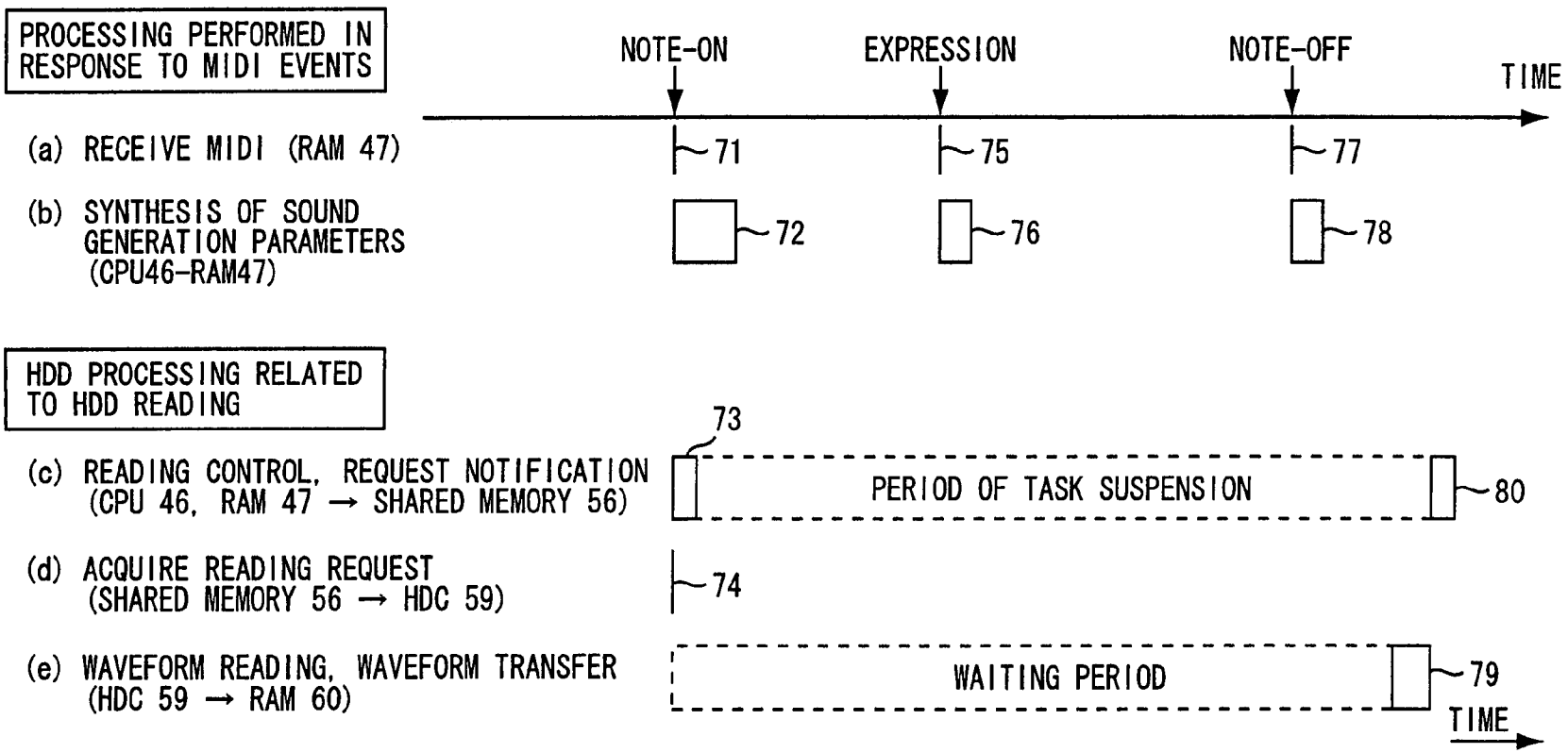
Figures 2, 3:
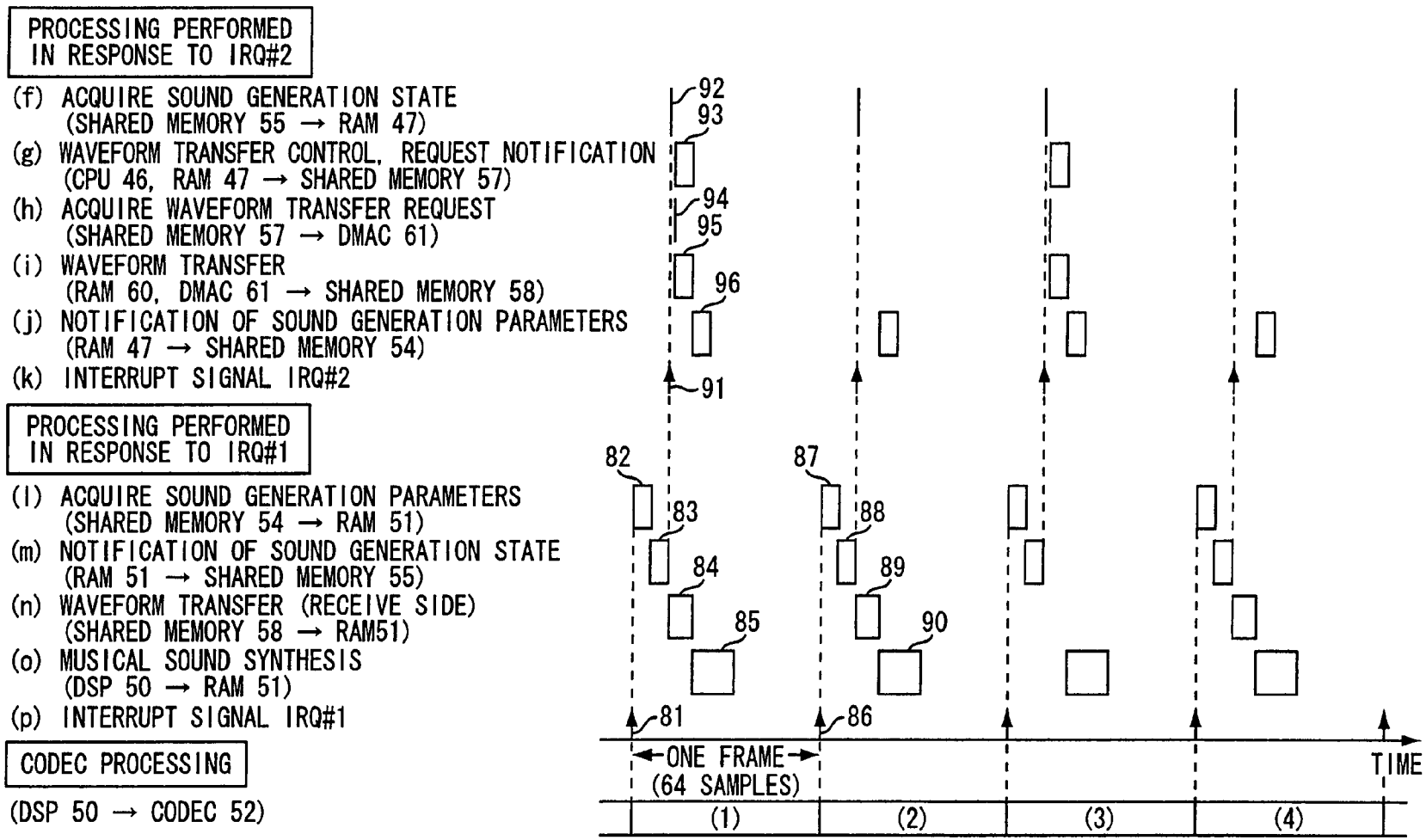
Figures 4A, 4B, 4C:
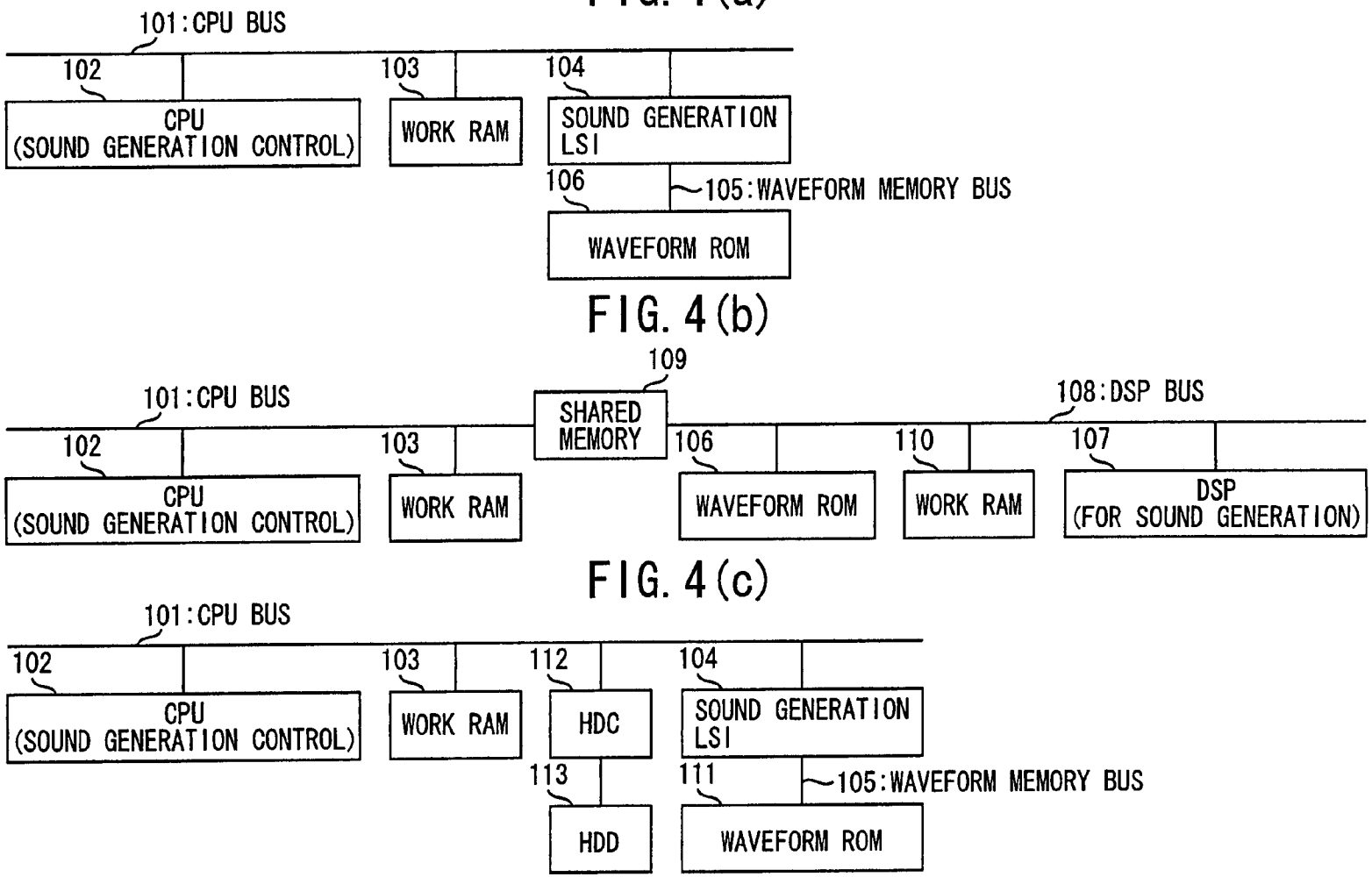
FIGS. 4(*a*), 4(*b*) and 4(*c*) are block diagrams showing some electronic music apparatuses of a waveform memory sound generation system.

FIGS. 3-1 and 3-2 are a sequence diagram for explaining an example of processing timing of each component in the specific example of FIG. 2.

The sequence of operations is divided into the following five parts: processing performed in response to MIDI events, processing related to HDD reading, processing performed in response to the IRQ#2, processing performed in response to the IRQ#1, and CODEC processing.

In FIGS. 3-1 and 3-2, the processing performed in response to MIDI events and the processing related to HDD reading proceed in different time units from the others.

The DSP 50 performs signal processing for musical sound synthesis in units of frame periods. If the sampling clock is 44.1 kHz and one frame is 64 samples, one frame period is about 1.45 msec.

It is assumed that the program and data necessary for operating the CPU 46 are stored in the Boot ROM 49. In this case, they are transferred to the work RAM 47 on system startup to start the execution of the program.

Similarly, the program and data necessary for operating the DSP 50 are stored in the Boot ROM 53, and transferred to the work RAM 51 to start the execution of the program.

When musical sounds are to be generated in real time, the reading request is notified from the CPU 46 on system startup or so that the first piece of all waveform data that could be used to generate sounds will be transferred in advance from the HDD 44 to the RAM 60 through the HDC 59, and held in the RAM 60 during the musical sound synthesis processing.

The following takes simple performance information as an example to describe a sequence of operations from receiving performance information "note-on" to start generating one sound to receiving performance information "note-off." In this example, performance information "expression" is received halfway through the sequence of operations to change the sound volume.

As shown in FIG. 3-1(*a*), pieces of performance information (waveform control information) 71, 75, and 77 are received as MIDI data, and inputted into the work RAM 47. Then, as shown in FIG. 3-1(*b*), the CPU 46 uses MIDI events, such as note-on, note-off, control change, and pitch bend, as triggers for creating sound generation parameters.

Although not shown, the sound generation parameters are also created in response to a time interrupt of 5 to 20 msec. during generation of the sound.

The sound generation parameters are created based on performance data like the MIDI data, and "the normal sound generation state" (state of sound waveform synthesis) including the key-on state, the current state of the amplitude envelope as mentioned above.

The CPU 46 creates the sound generation parameters 72, 76, and 78 on the work RAM 47. Time required for the creation processing is not constant.

The CPU 46 controls the reading of HDD 44. Then it determines waveform data expected to be newly necessary for further musical sound waveform synthesis based on the MIDI data received.

As shown in FIG. 3-1(*c*), a reading request 73 for reading, from the HDD 44 to the work RAM 60, the waveform data expected to be newly necessary is transferred from the work RAM 47 to the reading request shared memory 56.

For example, when MIDI data is received to start the generation of a sound with a certain pitch, waveform data on the waveform of the musical sound with the pitch sounded, and all pieces of waveform data on the waveforms of the musical sound in the range of possible pitches varying with pitch-bend operation from the original pitch of the sound (e.g., two octaves above or below the pitch of the actual note) are read out one by one from the HDD 44, and prestored in the work RAM 60.

Then, as shown in FIG. 3-1(*d*), the HDC 59 accesses the reading request shared memory 56 to read out a reading request 74 stored in it.

Then, as shown in FIG. 3-1(*e*), the HDC 59 reads out waveform data based on the reading request from the HDD 44, and transfers them to the work RAM 60.

The task of the CPU 46 is blocked until completion of requested reading at timing 79 as shown in FIG. 3-1(*c*). It allows the CPU 46 to transfer the next reading request 80 to the reading request shared memory 56 as soon as the reading of waveform data is completed.

The following describes the processing performed in response to the IRQ#2.

As shown in FIG. 3-2(*k*), an interrupt signal (IRQ#2) 91 is notified from the DSP 50 to the CPU 46. Then, as shown in FIG. 3-2(*f*), the CPU 46 reads out information on the sound generation state ("normal sound generation state" and the progress of musical sound waveform synthesis) 92 in the current frame (1) from the sound generation state shared memory 55, and writes it to the work RAM 47.

The CPU 46 calculates, based on the sound generation state (the progress of musical sound waveform synthesis) 92, the amount of waveform data remaining in the work RAM 51 as being necessary for the next fame (2) and further frames that follow the next frame, and transfers newly necessary waveform data, if any.

Then, as shown in FIG. 3-2(*g*), the CPU 46 sends the transfer request shared memory 57 the notification of a "transfer request" 93 for the transfer of waveform data from the work RAM 60 to the waveform buffer 58. The waveform data to be transferred correspond to those to be transferred to the work RAM 51 later.

Then, as shown in FIG. 3-2(*h*), the DMAC 61 on the side of the waveform data supplying unit 3 accesses the transfer request shared memory 57 to acquire a "transfer request" 94. In general, although the DMAC does not access a memory to read out data, since the DMAC 61 is a specialized type of DMAC or the shared memory block 45 has a function for notifying the DMAC 61 of the request, the DMAC 61 can acquire the "transfer request."

Then, as shown in FIG. 3-2(*i*), the DMAC 61 transfers waveform data from the work RAM 60 to the waveform buffer shared memory 58. The task of the transfer request is blocked until completion of transfer notified by the "transfer request" as shown in FIG. 3-2(*g*).

Finally, as shown in FIG. 3-2(*j*), the CPU 46 creates sound generation parameters based on the performance information and the "normal sound generation state" (state of sound waveform synthesis), and transfers the sound generation parameters stored in the work RAM 47 to the sound generation parameter shared memory 54.

The following describes the processing performed in response to the IRQ#1.

As shown in FIG. 3-2(*p*), interrupt signals (IRQ#1) 81, 86, . . . are generated every frame and supplied to the DSP 50.

Then, as shown in FIG. 3-2(*l*), the DSP 50 transfers sound generation parameters 82, 87, . . . from the sound generation parameter shared memory 54 to the work RAM 51.

The sound generation parameters are small in data size, so that the DSP 50 may transfer them to its internal RAM, rather than transfer to the work RAM 51.

Then, as shown in FIG. 3-2(*m*), the DSP 50 transfers the latest sound generation state 83, 88, . . . in the current frame (1) from the work RAM 51 to the sound generation state shared memory 55. As described above, the transferred sound generation state is transferred to the RAM 47 on the side of the control data processing unit 1 at timings as shown in FIG. 3-2(*f*).

The sound generation state is small in data size, so that the DSP 50 may transfer them to its internal RAM, rather than transfer to the work RAM 51.

Then, as shown in FIG. 3-2(*n*), it transfers waveform data 84, 89, . . . stored in the waveform buffer shared memory 58 to the work RAM 51. These transfers may be controlled directly by the DSP 50 itself. Alternatively, if the DSP 50 has a built-in DMAC (transfer controller 23) as in the embodiment, the built-in DMAC may control these transfers in accordance with instructions from the main unit of the DSP 50.

The waveform data stored in the waveform buffer shared memory 58 are waveform data read into the work RAM 60 as shown in FIG. 3-1(*e*) in response to the reading request 73 in FIG. 3-1(*c*), and stored in the waveform buffer shared memory 58 at timing 95 in FIG. 3-2(*i*). Note here that the waveform data read out in FIG. 3-1(*e*) are not indicated in FIGS. 3-1 and 3-2, because they were already read out before the period of the frame (1).

In other words, among the waveform data prestored in the work RAM 60, waveform data necessary for the next frame (2) and further frames that follow the next frame are determined based on the latest sound generation state (the progress of musical sound synthesis) 92 in the current frame (1) shown in FIG. 3-2(*f*), and stored in the waveform buffer shared memory 58.

Consequently, the waveform data 84 transferred to the work RAM 51 in FIG. 3-2(*n*) are waveform data necessary for the next frame (2) and further frames that follow the next frame.

Then, since it is determined that no new waveform data is necessary in the frame (2) period, no request for transfer of waveform data is created as shown in FIG. 3-2(*g*). As a result, no waveform data is transferred to the waveform buffer shared memory 58 as shown in FIG. 3-2(*i*), and hence to the work RAM 51 as shown in FIG. 3-2(*n*).

Then, as shown in FIG. 3-2(*o*), the DSP 50 reads out the sound generation parameters (normal sound generation parameters) 82 and the waveform data 84 stored in the work RAM 51, and performs, on the RAM 51, the musical sound synthesis of 64 samples in the next frame (2) based on the read parameters and the waveform data.

The DSP 50 performs musical sound synthesis for one frame one by one in order for each of channels capable of generating sounds at the same time, and adds the newly synthesized musical sound waveform data of the channels to the accumulated waveforms.

The CODEC 52 D/A-converts the musical sound waveform data for one frame stored in the work RAM 51 sample by sample to output a synthesized sound.

In the above description, the period for the transfer of waveform data from the waveform buffer shared memory 58 to the work RAM 51, and the period for the transfer of waveform data from the DSP 50 to the work RAM 51 do not overlap on the DSP bus 42 as shown in FIGS. 3-2(*l*) and 3-2(*n*) because the DSP 50 performs bus arbitration so that they will be done in rotation.

On the other hand, the HDD bus is so controlled that the transfer of waveform data from the work RAM 60 to the waveform buffer shared memory 58 by means of the DMAC 61 shown in FIG. 3-2(*i*) is given higher priority than the transfer of waveform data from the HDC 59 to the work RAM 60 shown in FIG. 3-1(*e*).

Consequently, if access contention occurs, bus arbitration will be done to interrupt the transfer of waveform data from the HDC 59 to the work RAM 60 and permit the transfer of waveform data from the work RAM 60 to the waveform buffer shared memory 58.

This priority control is done to prevent the reading from the HDD 44 from affecting the processing for musical sound waveform synthesis performed by the waveform data processing unit 2.

Suppose that the waveform buffer shared memory 58 is not provided and the HDD bus 43 is directly connected to the DSP bus 42 in FIG. 2. In this case, if the DSP 50 performs bus arbitration, part of actually required waveform data transferred from the HDC 59 to the work RAM 60 will be retransferred from the work RAM 60 to the work RAM 51. This causes an amount of waveform data that is double the predetermined transfer amount at the maximum to flow. Since the DSP bus 42 is intended to transfer considerable amounts of data, a traffic jam on the DSP bus 42 causes a transfer delay, resulting in an obstacle to the processing for musical sound waveform synthesis performed by the DSP 50.

In contrast, the structure with the waveform buffer shared memory 58 does not impair the data transfer capacity of the DSP bus 42.

Further, in the above description, the reading request is made as shown in FIG. 3-1(*c*) in synchronization with the completion of the waveform data reading operation shown in FIG. 3-1(*e*). Alternatively, a shared memory for storing notification of completion of the reading operation may be newly provided in the shared memory block 45, so that the notification of completion of the reading operation will be sent from the HDC 59 to the CPU 46 through the shared memory, thereby making the reading request asynchronously with the reading operation.

Likewise, a shared memory for storing notification of completion of the waveform transfer operation may also be newly provided in the shared memory block 45, so that the notification of completion of the waveform transfer operation will be sent from the HDC 59 to the CPU 46 through the shared memory, thereby making the transfer request asynchronously with the waveform transfer operation.

Further, in the above description, the reading request shared memory 56 is used as shown in FIGS. 3(*c*) and 3(*d*). Alternatively, an interrupt signal may be used to send the notification of a reading request from the CPU 46 to the HDC 59.

Likewise, such an interrupt signal may also be used to send the notification of a transfer request instead of the use of the transfer request shared memory 57.

Further, in the above description, the shared memories are used to notify the sound generation parameters and the sound generation state. Alternatively, the DSP bus may be provided with an I/O port through which it is connected to the CPU bus 41 like the reproduced sound generator 131 in FIG. 5. In this case, since such an I/O port is connected to both the DSP bus 41 and the CPU bus 41, there is no need to provide the sound generation parameter shared memory 54 and the sound generation state shared memory 55.

Figure 5:
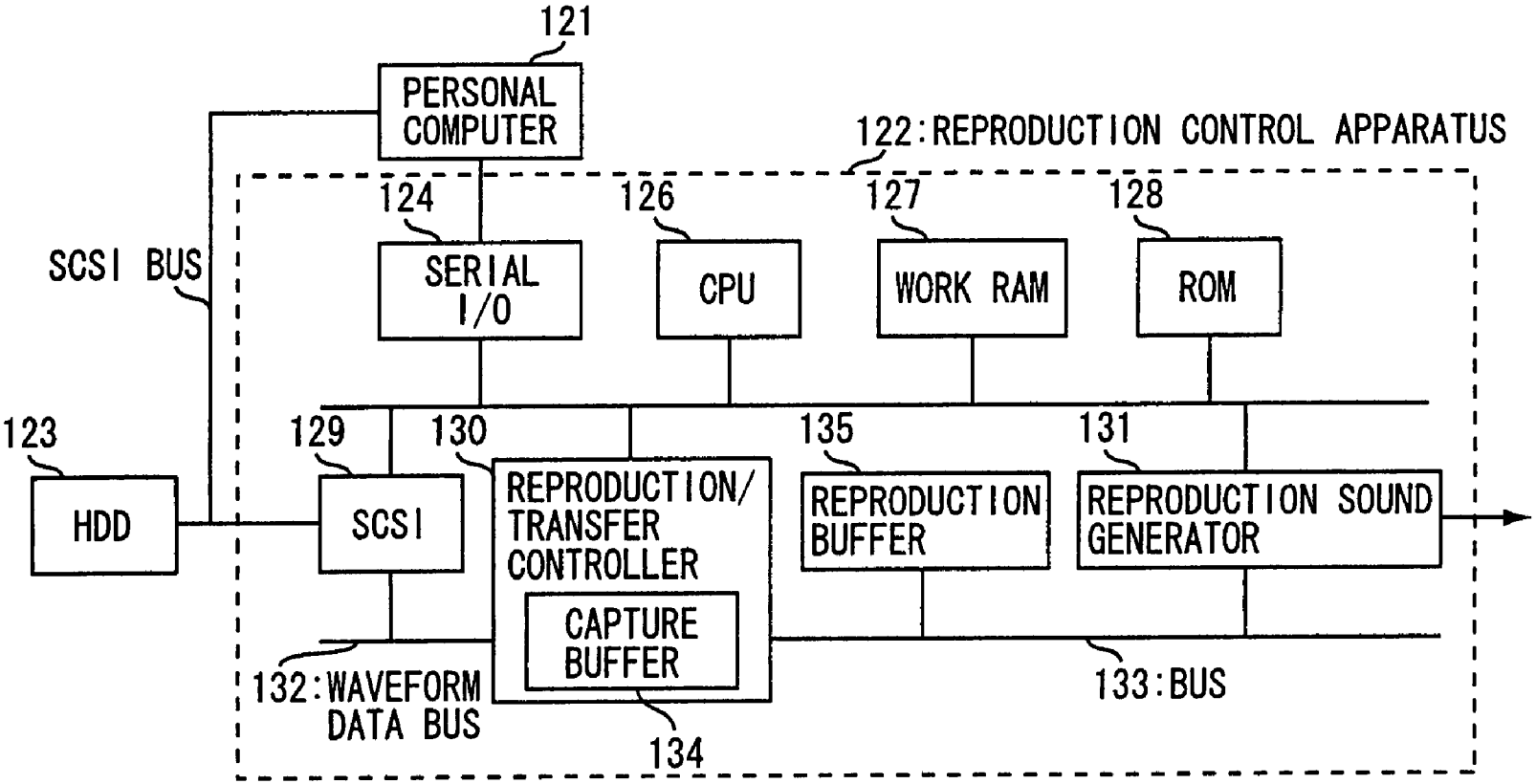
FIG. 5 is a block diagram showing a conventional musical sound data recording/reproducing apparatus.

Likewise, the HDC 59 and the DMAC 61 may also be provided with I/O ports, respectively, through which they are connected to the CPU bus 41 like the SCSI interface 129 in FIG. 5. In this case, there is also no need to provide the shared memories for notifying the reading request and the transfer request, respectively.

Further, in the above description, the processing program necessary for the operation of the CPU 46 and the processing program necessary for the operation of the DSP 50 are stored in the boot ROMs 49 and 53, respectively, and loaded into the work RAMs 47 and 51 on system startup.

Alternatively, the boot ROMS 49 and 53 may store only a boot loader to allow the processing programs to be stored in the HDD 44. In this case, the boot loader reads out each program from the HDD 44 on system startup and loads it into the work RAM 47 or 51.

To load the program from the HDD 44, a data buffer for program transfer has only to be provided in the shared memory block 45.

Further, the above description takes the HDD as an example of the waveform data storage, but it may be any other large-capacity storage even though it takes time to read data from its storage medium. For example, it may be a reproduction device for storage media, such as CD-ROM (Compact Disc Read Only Memory), MO (Magneto Optical Disk), and DVD (Digital Versatile Disk), or a low-speed RAM with large access delay. It may also be a USB2.0 flash memory or other flash ROM.

The above describes the specific example of the case where performance information such as MIDI messages inputted in real time is processed to synthesize a musical sound waveform.

However, music data such as an SMF (Standard MIDI File) stored in a storage can also be reproduced to synthesize a musical sound waveform. In this case, if music data are converted to real-time MIDI data according to time information (duration information) included in the music data, the musical sound waveform can be synthesized in the same manner as in the above specific example.

Alternatively, the time information may be included in the sound generation parameters (control parameters) in such a manner that the time information is notified to the DSP 50 and interpreted by the DSP 50 to synthesize the musical sound waveform.

In this case, since the delay time until the start of sounding can be predetermined, the capacity of the work RAM can also be reduced.

Further, the above description is made based on the assumption that the musical sound waveform is generated in a waveform memory sound generation system. However, the present invention is applicable to any other sound generation systems using waveform data as materials.

For example, it is applicable to a multi-performance AEM (Articulation Element Modeling) sound generation system.

Further, it is not limited to the synthesis of musical sound waveforms that imitate the sound of acoustic musical instruments. It may use musical sound waveforms created artificially. It is further applicable to the synthesis of human voice singing a song or making an announcement as long as the system is to synthesize sound waveforms. To sum up, the invention is applicable to the synthesis of sound including musical sound signals and human voice.

What is claimed is:

1. A sound waveform synthesizer apparatus for performing a sound waveform synthesis based on waveform control information provided from an outside and waveform data stored in a storage medium, the sound waveform synthesizer apparatus comprising:

a waveform data supplying section;

a waveform data processing section;

a waveform buffer connected between the waveform data supplying section and the waveform data processin section; and;

a control data processing section connected between the waveform data supplying section and the waveform data processing section, wherein the waveform data supplying section receives a first transfer request from the control data processing section and reads the waveform data from the storage medium for supplying the waveform data to the waveform buffer in response to the first transfer request;

the waveform buffer stores the waveform data supplied from the waveform data supplying section;

the waveform data processing section receives a second transfer request from the control data processing section and transfers the waveform data from the waveform buffer to the waveform data processing section in response to the second transfer request, the waveform data processing section performing the sound waveform synthesis based on the transferred waveform data and control parameters provided from the control data processing section, while notifying a state of the sound waveform synthesis and a progress of the sound waveform synthesis to the control data processing section; and the control data processing section creates the first transfer request based on the progress of the sound waveform synthesis notified from the waveform data processing section, and sends the waveform data supplying section the first transfer request, the control data processing section receiving the waveform control information from the outside and creating the control parameters based on the waveform control information and the state of the sound waveform synthesis notified from the waveform data processing section, the control data processing section sending to the waveform data processing section the second transfer request on the basis of the first transfer request together with the created control parameters.

2. The sound waveform synthesizer apparatus according to claim 1, wherein the waveform data processing section comprises a first bus, a first storage connected to the first bus for storing the waveform data, and a digital signal processor connected to the first bus for processing the waveform data during the sound waveform synthesis, while the waveform data supplying section comprises a second bus, a reading device for reading the waveform data from the storage medium and feeding the read waveform data to the second bus, and a second storage connected to the second bus for storing the waveform data, such that the waveform buffer is connected between the first bus and the second bus to transfer the waveform data from the second storage of the waveform data supplying section to the first storage of the waveform data processing section through the waveform buffer.

3. The sound waveform synthesizer apparatus according to claim 2, wherein the control data processing section further creates a reading request according to the waveform control information, and sends the reading request to the reading device of the waveform data supplying section, and wherein the reading device operates, when receiving the reading request for reading out the waveform data from the storage medium and transferring the read waveform data to the second storage.

4. The sound waveform synthesizer apparatus according to claim 3, wherein the waveform data supplying section includes a controller for controlling the second bus such that the transfer of the waveform data from the second storage to the waveform buffer is given higher priority than the transfer of the waveform data from the storage medium to the second storage.

5. The sound waveform synthesizer apparatus according to claim 3, wherein the control data processing section sends the reading request to the reading device of the waveform data supplying section prior to start of the input of the waveform control information into the control data processing section so that the waveform data will be transferred from the storage medium to the second storage in advance of the sound waveform synthesis.

6. The sound waveform synthesizer apparatus according to claim 1, wherein the waveform data processing section performs the sound waveform synthesis to synthesize a sound waveform a frame by frame basis based on the waveform data in synchronization with a given frame period such that each frame contains a plurality of samples of the sound waveform, and wherein the waveform data supplying section operates when receiving the first transfer request for transferring the waveform data from the storage medium to the waveform buffer in correspondence to the frame period.

7. A method of operating a sound waveform synthesizer apparatus comprised of a waveform data supplying section, a waveform data processing section, a waveform buffer connected between the waveform data supplying section and the waveform data processing section, and a control data processing section connected between the waveform data supplying section and the waveform data processing section, for performing a sound waveform synthesis based on waveform control information and waveform data, the method comprising the steps of:

operating the waveform data supplying section when receiving a first transfer request from the control data processing section for reading the waveform data from a storage medium and supplying the read waveform data to the waveform buffer in response to the first transfer request;

operating the waveform buffer for storing the waveform data supplied from the waveform data supplying section;

operating a waveform data processing section when receiving a second transfer request from the control data processing section for transferring the waveform data from the waveform buffer to the waveform data processing section in response to the second transfer request;

operating the waveform data processing section to perform the sound waveform synthesis based on the transferred waveform data and control parameters fed from the control data processing section, while notifying a state of the sound waveform synthesis and a progress of the sound waveform synthesis to the control data processing section;

operating the control data processing section to create the first transfer request based on the progress of the sound waveform synthesis notified from the waveform data processing section and to send the waveform data supplying section the first transfer request;

operating the control data processing section when receiving the waveform control information from the outside for creating the control parameters based on the waveform control information and the state of the sound waveform synthesis notified from the waveform data processing section; and operating the control data processing section to send the waveform data processing section the second transfer request on the basis of the first transfer request together with the created control parameters.

* * * * *